US006910354B2

(12) United States Patent
Ciucani

(10) Patent No.: US 6,910,354 B2
(45) Date of Patent: Jun. 28, 2005

(54) PROCESS AND AN APPARATUS FOR PROCESSING ANIMAL HIDES

(76) Inventor: Mario Ciucani, C. da S. Girolamo 5/C, Fermo (IT)

( * ) Notice: Subject to any disclaimer, the term of this patent is extended or adjusted under 35 U.S.C. 154(b) by 548 days.

(21) Appl. No.: 10/148,541

(22) PCT Filed: Dec. 7, 2000

(86) PCT No.: PCT/IB00/01816

§ 371 (c)(1),
(2), (4) Date: Jul. 3, 2002

(87) PCT Pub. No.: WO01/42514

PCT Pub. Date: Jun. 14, 2001

(65) Prior Publication Data

US 2003/0233709 A1 Dec. 25, 2003

(30) Foreign Application Priority Data

Dec. 10, 1999 (CH) ..... 2275/99

(51) Int. Cl.[7] ..... C14C 1/00
(52) U.S. Cl. ..... 69/28; 69/29; 69/31; 69/22
(58) Field of Search ..... 69/19.1, 19.2, 69/19.3, 21–32

(56) References Cited

U.S. PATENT DOCUMENTS 1,832,235 A 11/1931 Nance
4,242,811 A * 1/1981 Moriyama et al. ..... 34/614
4,438,570 A * 3/1984 Dokoupil ..... 34/266
4,596,124 A * 6/1986 Korpi et al. ..... 69/40
5,291,759 A * 3/1994 Dokoupil ..... 69/19.1
6,251,414 B1 * 6/2001 Lauton et al. ..... 424/402

FOREIGN PATENT DOCUMENTS

WO WO 97/42350 11/1997

OTHER PUBLICATIONS

Gregor, T., Muller, L., and Rodel, K., Removing hair from animal skin and hide—by pretreatment in soln. of sodium hydroxide and hydrogen peroxide followed by white lime hair removal, Nov. 21, 1990, Tech Univ Marx K (Abstract).

* cited by examiner

*Primary Examiner*—Gary L. Welch
(74) *Attorney, Agent, or Firm*—William J. Sapone; Coleman Sudol Sapone PC

(57) ABSTRACT

A process for treating animal hides includes spreading the hides (1) to be treated astride respective supporting plates (2) and introducing the plates into a container (10). Afterwards, the container (10) is closed hermetically and set under vacuum. A liquid solution is introduced into the container (10), to treat the hides, in particular to transform fresh animal hides into wet white state. The container (10) is driven into vibration, to make the solution contained in the container (10) move in a continuous and uniform way.

19 Claims, 6 Drawing Sheets

FIG. 1
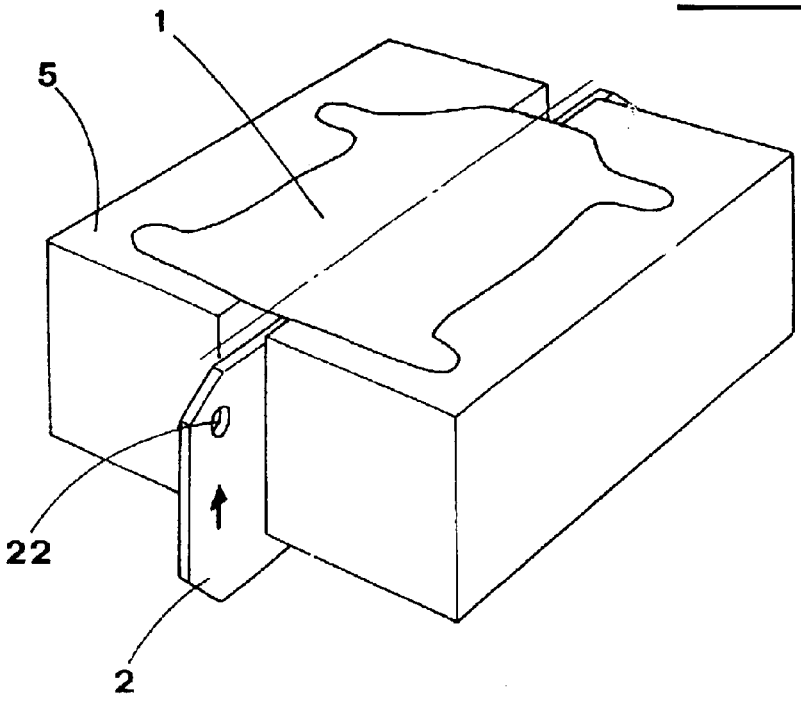
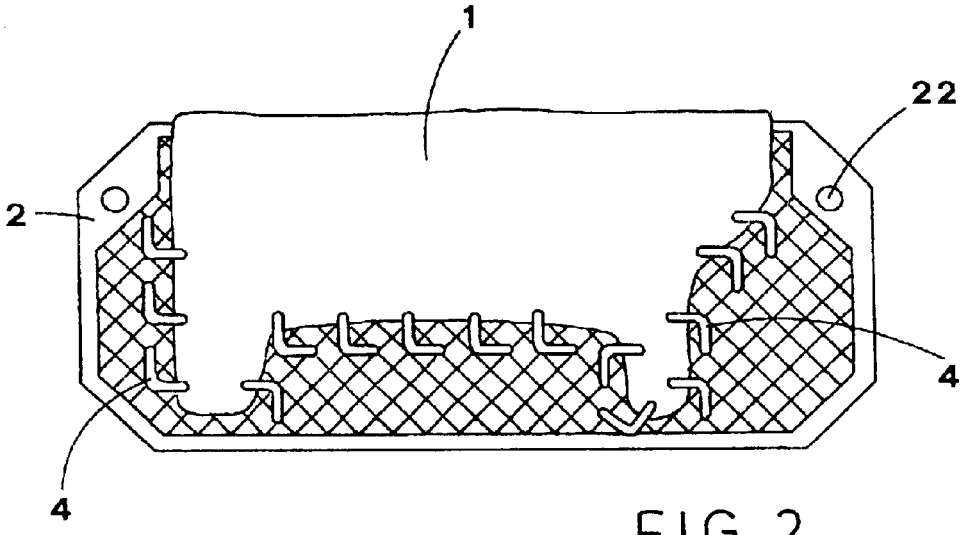
FIG. 2

PROCESS AND AN APPARATUS FOR PROCESSING ANIMAL HIDES

BACKGROUND OF THE INVENTION

The present invention relates to a process and an apparatus for treating animal hides.

In particular, the invention relates to an industrial process for transforming the fresh hide into wet white state.

DESCRIPTION OF THE PRIOR ART

As it is known, the term "wet white" indicates animal hide stripped of the hair, flesh and other surface impurities, integral or divided in leather grain and split leather, stabilized definitely, humid or dry and whitish.

The last mentioned characteristic makes the "wet white" hides different from the "wet blue" hides, which are obtained by tanning using chemical agents such as chromium giving the characteristic bluish or anyway, not natural, color.

For a very long time, the animal hides have been treated with substances which fix to the hides irreversibly.

Then, the tanning has become an industrial process, mainly after the chromium treatment had allowed to considerably reduce the process time.

Actually, the tanning process usually includes a series of steps, whose execution requires long times.

The very tanning is preceded by different preparing treatments, which remove still present impurities and fat and subsequently, hair.

The main problem of the animal hides treatment results from the fact that the hide, being of natural origin, is subject to rapid putrefaction, specially in those areas where the climate accelerates the bacterial action, which causes the decomposition thus ruining the hide commercial value.

The first treatment of animal hides usually takes place in the fresh hides collecting plant, and sometimes even in the slaughter houses, where the hides are treated with sodium chloride, i.e. common kitchen salt, so as to prevent the decomposition and putrefaction.

The treatment of the inner part of the hide, with sodium chloride causes pollution and moreover, it can damage the so-called grain of leather, thus causing a quality decay, if not rejection of the hide, which would result in further problem of disposal.

This salting and preserving phase affects a great part of the whole tanning process, which includes a long series of treatments by different systems and substances creating an unhealthy working environment and compromising the environment situation.

The salt is used also later, in the so-called "pickling" operation, which determines a better penetration of tanning salts, e.g. chromium salts.

The above treatments are usually performed in special drums, with appropriate liquid substances.

The drums are big, so as to allow high productivity, since the time of the treatment is long, anyway changing in relation to the characteristics of treated hides.

Therefore, a particular problem occurring in the examined field results from the necessity to reduce the environment pollution caused by tanning industry, in particular by industrial discharges.

Actually, the substances used for treatments are highly polluting and their remains can be dispersed in the environment only after an appropriate depuration.

SUMMARY OF THE INVENTION

The object of the present invention is to propose a process which allows to treat animal hides, reducing the environmental impact thereof, and in particular, eliminating the use of chemical substances, thus avoiding the necessity to use any depuration system.

Another object of the present invention is to propose a process which reduces working time and production costs, without affecting the product quality.

A further object of the present invention is to propose a process which reduces considerably the quantity of the substances used in various -treatments, in particular using a reduced quantity of easily available and widely available substances.

A still further object of the present invention is to propose an apparatus, which carries out the above described process, by a simple, practical, and compact structure occupying very limited space.

The above mentioned objects are obtained, in accordance with the claims, by a process for treating animal hides including:

spreading hides to be treated astride respective support plates;

introducing said supporting plates with said hides to be treated into a container, which is them closed hermetically;

setting said container under vacuum;

introducing a liquid treating solution into said container kept under vacuum;

driving said container into vibration, so as to make said treating solution introduced therein move in a constant and uniform way.

According to a second embodiment, the process includes:

spreading hides to be treated astride respective support plates;

introducing said supporting plates with said hides to be treated into a container, which is then closed hermetically;

setting said container under vacuum;

introducing a liquid treating solution into said container kept under vacuum.

The process is carried out by an apparatus for processing hides and the like, characterized in that it includes:

a series of plates supporting hides to be treated, spread astride said plates;

a container, which is closed hermetically, said supporting plates with hides to be treated being introduced into said container;

means for setting said hermetically closed container under vacuum;

at least one mixing reservoir, fed with water and suitable active principles, so as to obtain a liquid solution for treating said hides, said mixing container being set in communication with said hermetically closed container kept under vacuum, so as to introduce thereinto said liquid solution;

a vibrating element for driving said container into vibration, so as to make said liquid solution introduced into said hermetically closed container move in a constant and uniform way.

BRIEF DESCRIPTION OF THE DRAWINGS

The characteristic features of the present invention will be pointed out in the following description with reference to the enclosed drawings, in which:

FIG. 1 is a schematic prospective view of a table, on which the hides to be treated are prepared;

FIG. 2 s a lateral view of a hide placed on a support plate;

BEST MODES OF CARRYING OUT THE INVENTION

Figure 3:
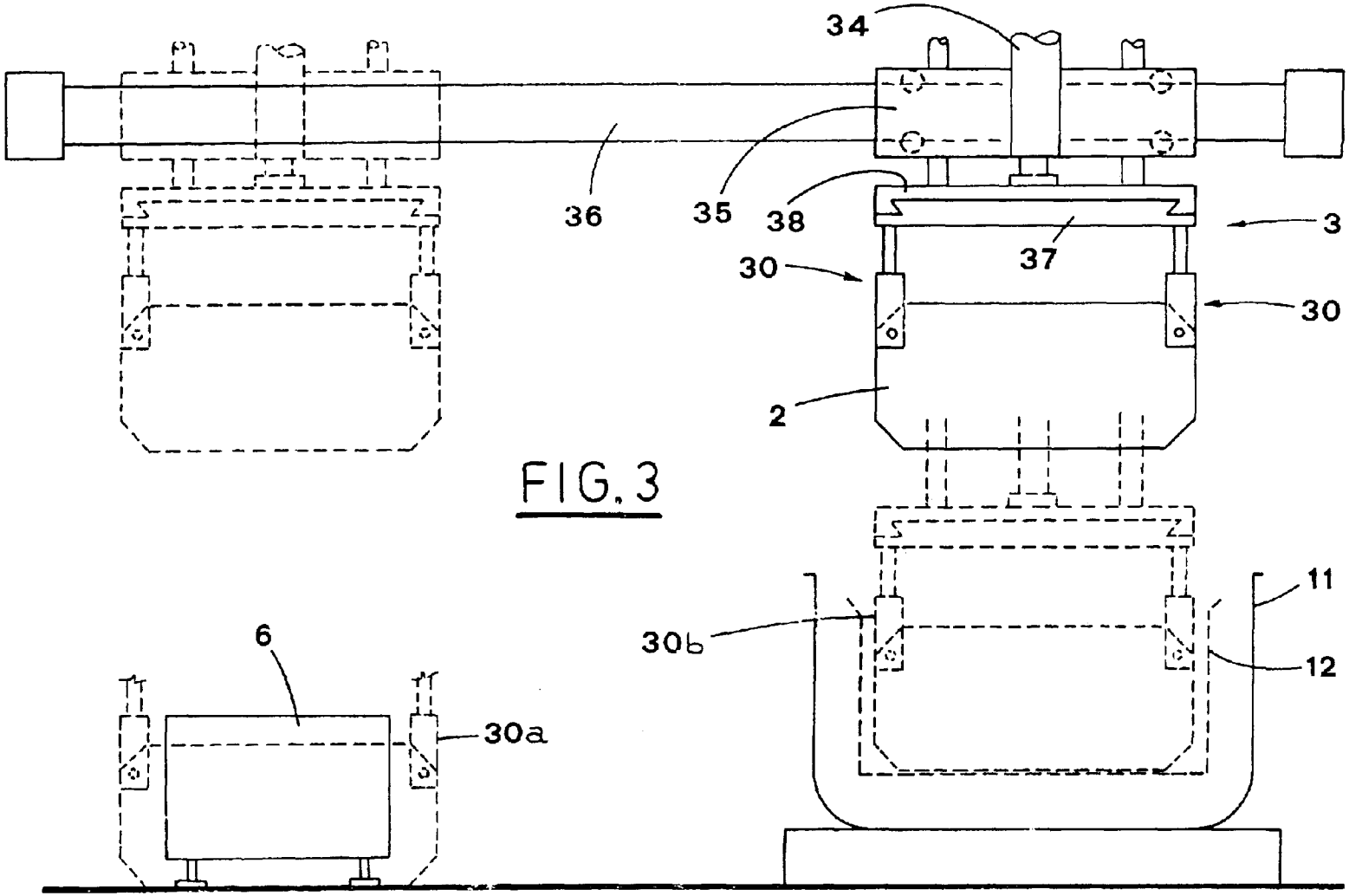
FIG. 3 is a schematic lateral view of a device for transferring the hides to be treated to a treatment container.

With reference to the above described figures, reference numeral 1 indicates hides to be treated in the proposed way.

The proposed process begins with fresh or refrigerated hides, as generally produced in slaughter houses, and not treated with salt, but specially selected in relation to quality and size types, and stripped of possible parts, which cannot be treated.

The hide 1 to be treated is first examined on a preparation table 5, formed by two surfaces brought close to each other, classified, prepared and then spread astride a support plate 2, with the grain part turned outward. The head—tail axis is located near the upper edge of the plate 2 (FIG. 1).

The plate 2, made of a plastic material, has many holes, which are aimed at receiving hooks 4 for fastening the hide 1.

Actually, the hide 1 is maintained stretched and adhering to the plate 2 by the hooks 4 applied manually to the hides edges (FIG. 2).

Different lots of hides are weighed and placed on suitably numbered metallic carriages, each of which is equipped with a card containing information about the load.

Afterwards, the carriages are moved to a magazine refrigerating chamber, from which they are taken when the treatment is to begin.

According to the proposed process, the hides 1 are treated in only one container, indicated with the reference numeral 10, inside which the hides are folded over the relative plates 2.

The hides are taken out from the container 10 when the cycle is finished and the hides have reached the wet white state.

More precisely, the container 10 includes a cylindrical pot 11, made of metal and featuring a watertight cover, inside which a basin 12 is situated and fixed therein.

Figure 6:
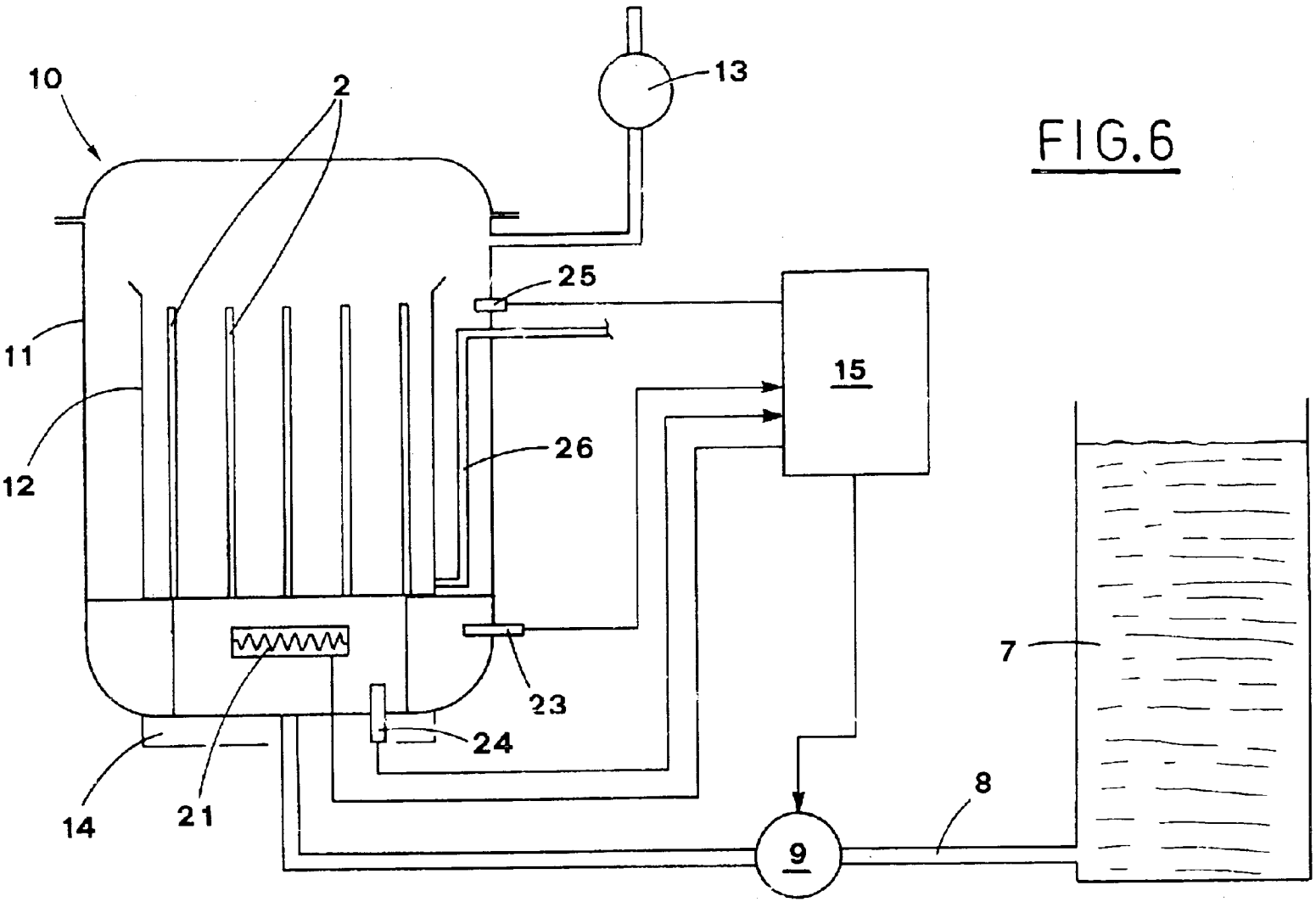
FIG. 6 is a schematic view of the above treatment container and the means connected thereto.

The basin 12 is made of stainless steel and does not have a cover (see FIG. 6).

The structure of the outer pot 11 is such that it resists to a negative pressure of −0.9÷−0.975 atmospheres.

The pot 11 is coated externally with a heat-insulator, so as to avoid heat dispersion and facilitate inner temperature stability.

In fact, the function of the pot 11 is to create a hollow space filled with water around the basin 12.

The plates 2 with the hides 1 are placed inside the basin 12.

A transferring device 3 including a pair of pliers means 30 introduces the plates 2 into seats defined by guiding means 20 fastened inside the basin 12 (FIG. 3).

Figure 5:
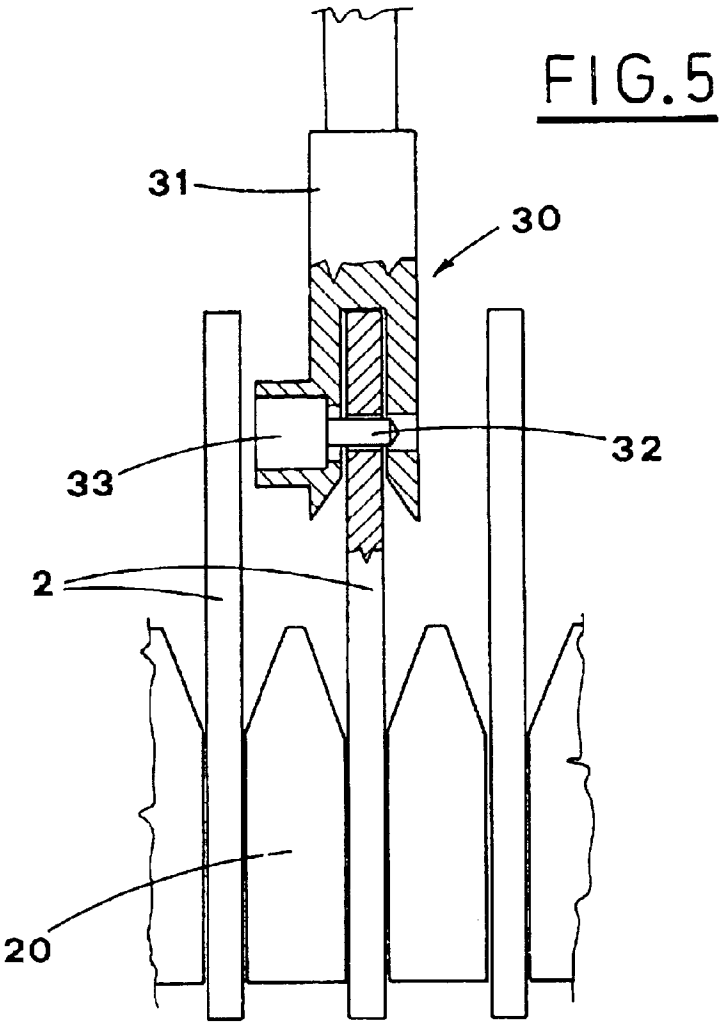
FIG. 5 is a corresponding front view of the above pliers means used in the proposed apparatus.
Figure 4:
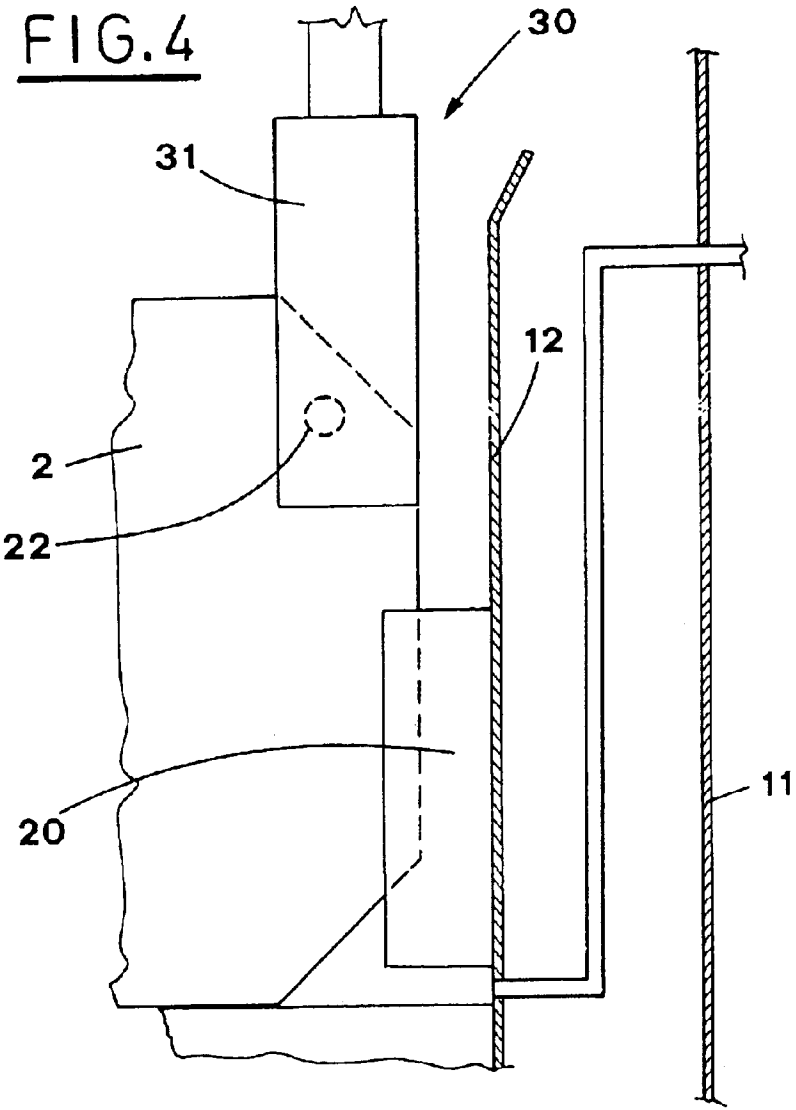
FIG. 4 is a lateral view of an enlarged particular of the treatment container, which shows pliers means used in the proposed apparatus.

As shown in detail in FIGS. 4 and 5, the pliers means 30 include respectively a fork 31 featuring a tapered introduction section into which the plate 2 is introduced, and a coupling element 32 operated by a pneumatic actuator 33, so as to couple with a corresponding hole 22 made in the plate 2.

The guides 20 are fastened to the opposite walls of the basin, so as to form grooves, which receive the plates 2 carrying the hides.

The guides 20 are made of stainless steel bars, and their upper ends are suitably tapered to facilitate the plates 2 introduction.

The pliers means 30 are moved vertically by a pneumatic piston 34, carried by a first slide 35, which is moved by suitable operating means along a second horizontal slide 36 (see again FIG. 3).

The pliers means 30 are carried by a third slide 37, which is moved horizontally and perpendicularly to the second horizontal slide 36, by a corresponding fourth slide 38 fastened to the stem of the piston 34.

Consequently, the transferring device 3 allows to move the pliers means 30 in three orthogonal directions, so as to move them between a taking position 30*a*, in which the plates 2 are taken from a carriage 6 and a release position 30*b*, in which the plates 2 are released inside the basin 12.

A heating member 21, e.g. an electric resistor, a thermometer 23 for controlling the temperature and a manostat 24 are situated on the bottom of the pot 11.

A proximity switch 25 for controlling the water level is situated in the upper part of the pot 11.

The pot 11 is connected to a vacuum pump 13, which creates an environment with a negative pressure aimed at enlarging the hides pores.

The environment created by the vacuum pump 13 is not subject to the atmospheric pressure, thus it facilitates the circulation and efficiency of substances which are introduced into the basin 12 during each treatment step.

The equipment includes also an electrically operated vibrating element 14, positioned in such a way as to transmit the vibrating movement to the cylindrical pot 11 and consequently, to the inner basin 12.

The vibration determines a continuous, constant and uniform movement of the solution introduced into the basin, assuring the complete treatment of the outer surface of the hide or its grain.

The inner parts of the hide are treated only slightly, as protected by the supporting plate 2, to which the hide adheres.

The water is fed to the container 10 from a tank 7 by a pipe 8, along which a pump 9 is situated.

The basin 12 has squared cross-section, which matches with the known shape of the half-piece of hide. The bottom of the basin is inclined.

Figure 7:
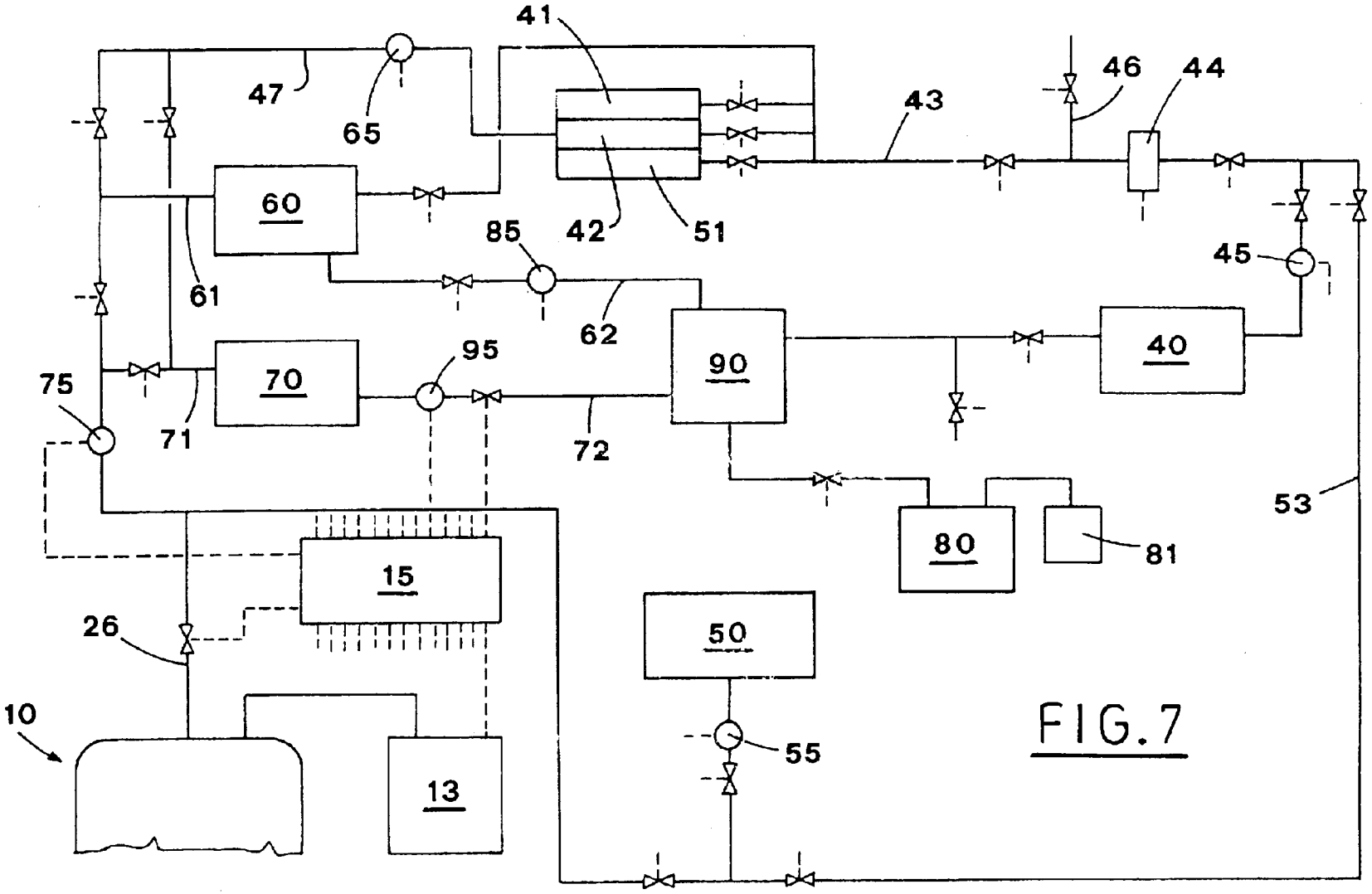
FIG. 7 is a schematic view of the whole apparatus for treating animal hides according to the present invention.

The basin 12 is connected, by a unique stainless steel pipe 26 passing through the cylindrical pot 11, to mixing reservoirs 40, 50 and to decantation reservoirs 60 and to liquid collection reservoirs 70, in which the liquids are collected at the end of the cycle (FIG. 7).

It is to be pointed out that the above reservoirs can advantageously have same volume as the basin 12.

An outlet connector is connected to the lower part of the sloping bottom of the basin 12 and is joined to a pipe, which sucks the liquid and solid remains, when the cycle is completed. The sucked remains are conveyed to the decantation reservoirs 60, if the remaining water is to be reused, or to the collection reservoirs 70, if the remaining water is to be treated by boiling.

More precisely, the mixing reservoir 40 mixes water, sodium hydroxide i.e. caustic soda, and hydrogen dioxide.

The hydrogen dioxide and the caustic soda are taken from respective tanks 41, 42 connected to the mixing reservoir 40 by a pipe 43 equipped with a liquid meter 44. Also a water supply pipe 46 is connected to the pipe 43.

The mixing reservoir 50 mixes the hydrochloric acid, taken from a related container 51 by a pipe 53, which is a branch of the pipe 43.

The apparatus includes also a reservoir 80 for collecting solid remains and connected to an additional suction pipe 81 or alternatively, to the main suction pipe 13.

Moreover, the equipment includes an evaporator 90, which basically includes a boiler made of copper enclosed in a insulated concrete container.

The decantation reservoir 60 and collection reservoir 70 for collecting liquids when the cycle is finished, are fed by the pipes 61, 71 which are branched from the pipe 26 going out of the basin 12, and are connected to the evaporator 90 by further pipes 62, 72.

The decantation reservoir 60 and liquids collecting reservoir 70 are connected also to the caustic soda container 42 by a pipe 47.

All the movements of the liquids and remains, their dosing, mixing and relative paths, are controlled by relative motor-powered pumps 45, 55, 65, 75, 85 and 95, operated according to predetermined time programs.

The motor-powered pumps, as well as the valves disposed along the above mentioned pipes and suction pipes are controlled electronically by a control unit 15, which receives also signals given by the measuring instruments such as thermometers, manostats, pH-meters and the like, connected to different containers or reservoirs.

It is enough to introduce into the control unit 15 only the data concerning the weight and color of the hides to be treated, to define automatically all the variables, throughout the production cycle, such as the quantity of liquids, mixing times, pressure and temperature values and the like.

In practice, the proposed process includes a first step, during which the hides are cleaned, and which starts with heating to about 30° C., the water contained in the cylindrical pot 11. The water fills the pot up to a level slightly lower than the edge of the basin 12.

An aqueous solution is composed by adding 96% by volume of water, 2% by volume of caustic soda and 2% by volume of hydrogen dioxide, in the mixing reservoir 40. The quantity of the aqueous solution is calculated in relation to the weight of the hides to be treated. The aqueous solution is heated at the same temperature.

When the above mentioned temperature is reached, the fresh hides to be treated, placed each one on a supporting plate 2, are taken from the carriage 6 and introduced into the basin 12 by the transferring device 3.

Afterwards, the cylindrical pot 11 is closed tightly and the suction pump 13 is started, until a negative pressure of about −0.5 atm is obtained inside the container 10.

After about 15 minutes, the vibrating element 14 is operated, while the vacuum condition and the temperature of the liquid are maintained constant by the special manostat 24 and thermostat 23.

Due to the pressure difference, by opening the connecting pipe, the solution contained in the mixing reservoir 40 is sucked completely into the basin 12.

This solution, already quantified according to the above mentioned parameters, reaches a level which covers the whole mass of hides 1 placed in the basin 12.

When the solution has been transferred to the basin 12, a new mixture of water, caustic soda and hydrogen peroxide is prepared in the mixing reservoir 40, in quantity necessary for the next cycle.

The vibration of the container 10, maintained for a period of time necessary for the treatment, makes better the action of the solution introduced into the basin 12, ensuring the complete treatment of the outer surface, or grain, of the hides, while the inner surface is treated only slightly, since protected by the plate 2, to which it adheres.

Thermostat 23 and manostat 24 ensure the constancy of the temperature inside the basin 12 and of the negative pressure inside the container 10 during the whole operation.

It is to be noted that the solution, in which the fresh hides are immersed, stops the hides decomposition, due to the caustic soda contained in the solution.

The proposed process can be used also in areas with particularly hot climate, because it begins almost immediately after the fresh hides have been taken from the refrigerating chamber.

The hides are subject to the action of the above mentioned solution, with the temperature, pressure and vibration generally constant, for a predetermined period of time corresponding to seven hours in case of hides with black hair, four hours in case of white hide, and six hours if the hair is of different color or spotted.

The hair is decomposed due to the action of the hydrogen peroxide and caustic soda.

The oxidative and radicalic action of the hydrogen peroxide takes place on; the cuticle membrane and the alpha-keratins constituting the hair.

The cutting action takes place in the neck area, which is usually intracutaneous.

Due to the decompression, the neck comes out and thus can be attacked more rapidly, because its section is smaller with respect to the hair medium section.

The action of the hydrogen peroxide can be either radicalic or oxidative on the membrane and the glycocalyx, the glicoproteic structure present on the membrane surface which confers the adherence between the cells.

The change of the fatty acid structure determines a loss of the membrane stability with breaking the structure $$ROH+HO^{*}\rightarrow RO^{*}+H_2O$$

$$2RO^{*}\rightarrow R—O—O—R$$

$$RO^{*}+R—NH_2\rightarrow ROH+R—NH^{*}$$

$$R—NH^{*}+R—OH\rightarrow R—NH_2+RO^{*}$$

The radicals attack the structure of the glucides and amino acids on the groups —OH and —$NH_2$; moreover, the action of the hydrogen peroxide oxidizes the groups R—$CH_2$—OH and R—CO—H.

This way, all the structures stabilized by hydrogen links are changed due to breaking of the interactions.

The caustic soda acts on different levels on the membrane changing the structure due to phospholipidic hydrolysis

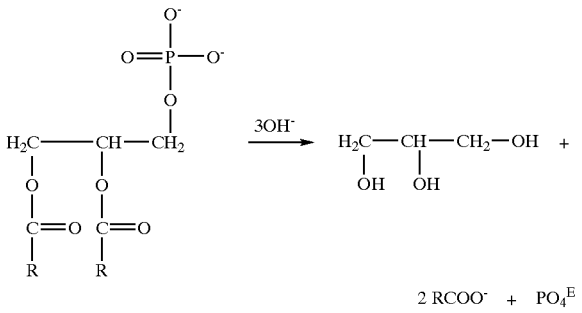

This way, the structure is destroyed and the carbo-amidic link is hydrolyzed thus releasing the amino acids of the alpha-keratin protein.

After the first treatment has been finished, its duration being determined by a timer, the hides are devoid of hair and cleaned in a strongly basic environment, with the pH value of about 14.

When the hides cleaning step is finished, the basin 12 is brought back to the atmospheric pressure and all the liquid contained therein, including the organic debris of the cleaning process, is sent to the mixing reservoir 50, to start hide stabilization step.

A quantity of hydrochloric acid sufficient to neutralize the caustic soda, e.g. equal to 0,5% of the initial water volume, is taken from the container 51.

The hydrochloric acid is conveyed to the mixing reservoir 50, into which a jet of air flows to facilitate complete liquids mixing.

Meanwhile, the basin 12 is brought back to decompression and after a negative pressure of −0.5 to −0.6 atmospheres has been reached, the whole contents of the reservoir 50 is sucked.

The task of the hydrochloric acid is to neutralize the quantity of soda present in the solution and absorbed by the hide.

This takes place by the combination of the hydrochloric acid with the soda dissolved in the basin 12, which generate sodium chloride.

This operation is controlled by a special pH-meter, which, when the neutral value is reached, gives the end-of-cycle command by starting the pump, which sucks the whole solution or suspension contained in the basin.

The hydrochloric acid causes also narrowing of the hide pores, thus avoiding the damages to the hide grain by the tanning products during the wet white tanning or coloring.

The above described step of hide stabilizing does not have a fixed duration, because it depends on the initial pH value and on the time necessary to bring it to the value 7.

Then, the basin 12 is brought again to the atmospheric pressure, the hides are removed therefrom and placed in a special rack to dry. A remains treatment step follows.

The aqueous suspension resulting from the process can be conveyed to the collection reservoir 70, if it is to be evaporated. If the solid debris are to be decanted and only the surface aqueous solution is to be collected, and conveyed to the evaporator 90, for next use, then the aqueous suspension is sent to the decantation reservoir 60.

In the first case, partially dried solid remains are obtained, which are sucked from the collecting reservoir 80, while the water depurated by boiling in the evaporator 90 can be sent to the mixing reservoir 40 for the next cycle, or dispersed in the environment.

In the other case, after the separation of the surface liquid, the sediment is sucked by the collecting reservoir, as in the previous case.

It is to be noted that in both cases, before the resulting substance is sent to the evaporator 90 or the collecting reservoir 80, it is treated by adding caustic soda until pH reaches value 7.

The soda is taken from the related container 41 and automatically sent to the decantation reservoir 60 or 70.

Thus, the described process achieves the object of providing an animal hides treatment which reduces the negative effect on the environment, in particular eliminating the use chemical substances, and consequently avoids the necessity for a depuration system.

A first characteristic of the proposed process is the elimination of the initial salting, used in known tanning methods, since the process starts with fresh hides.

In this way, costs of salting, desalting and soaking are avoided, as well as the damages which such operations can cause not only to the hides, but also to the environment.

Actually, the described process can be intended as the continuation of the slaughtering operations, rather than tanning and pre-tanning, even if the results are the same, as to the nature and destination of the final product.

Another characteristic of the proposed process is to considerably limit substances used for different treatments.

In particular, the process requires only three substances easily available and of moderate cost (hydrogen dioxide, caustic soda and hydrochloric acid), yet obtaining best results in hides stabilizing as well as in semi-finished product properties.

Consequently, all the chemical substances used in known tanning art are eliminated and likewise, the relative disposal operations.

Actually, the proposed process does not need any depuration equipment, since the corresponding operation is reduced to a simple treatment of wastes, which can be re-cycled e.g. in agricultural field.

Another advantage of the proposed process results from the fact that sodium chloride is generated during the hides treatment, and the hides are prepared to receive it uniformly and deeply.

Another advantage of the invention derives from the compactness of the system using only one treating basin, thus eliminating hides transferring and the use of traditional drums, and reducing the occupied space.

The proposed solution is particularly suitable also for slaughter houses.

This is very advantageous in case of principal hide producing countries, where the law obstacles, or even forbids exporting of raw hides, while it allows to export semi-finished hides, i.e. "wet-white".

The proposed process allows also to reduce considerably the working time and production costs.

A very important advantage of the proposed process lies in saving a very precious good, i.e. water, whose consumption is insignificant, especially considering the fact that the remaining solutions are collected and reused.

Moreover, traditional tanning processes reduce the hides surface, while the proposed process tends to extend it by 5÷7%.

It is to be particularly pointed out that the proposed process does not involve an environmental impact, in complete accordance with the regulations in force concerning the disposal of industrial wastes.

In fact, as it has been said, the working wastes produced by the treatment for transformation raw hides in the wet-white state is a suspension of an aqueous liquid and organic particles.

After having been subjected to boiling and evaporation, the treatment wastes suspension are divided into liquid wastes and solid wastes.

The analysis of the above wastes gives the following results.

The pH, COD and chlorides parameters of the liquid wastes have been checked and the obtained results remain within the emission limits for industrial waste water as required by the regulation in force. Therefore, it is possible to apply for a regular authorization to discharge wastewaters to the surface waters.

The quality characteristics of the waste waters make them suitable to be reused in a production cycle.

As far as the solid wastes are concerned, all the parameters remain within the fixed limit values requested by the regulation in force concerning "use of depuration mud in agriculture".

Therefore, according to the provision of the related law, the wastes defined as "solids" deriving from the wet-white production process are classified as "special, not dangerous wastes, mud not containing chromium".

Thus, according to the processes concerning the compostible wastes, they can be reused in agriculture or disposed in a controlled discharge for urban solid wastes and the like.

The proposed process not only ensures a deep and complete treatment of the hides, but also improves the product quality at lower costs, with respect to the quality obtained by known tanning process.

From the economic-ecological point of view, the advantages of the proposed process, are still more evident. It is enough to mention the elimination of the salting and numerous chemical additions, and in particular, the investments and the operation and maintenance costs of the present depuration systems, which are often of poor efficiency and do not resolve the serious problem of the disposal of toxic muddy wastes.

The modular structure of the system is to be pointed out, i.e. the system can have dimension selected in relation to the quantity flow of the available hides.

Apart from economic consideration, like the amortization one, it is possible to produce equipments able to treat fifty or a hundred or a thousand or even more hides per day.

Figure 8:
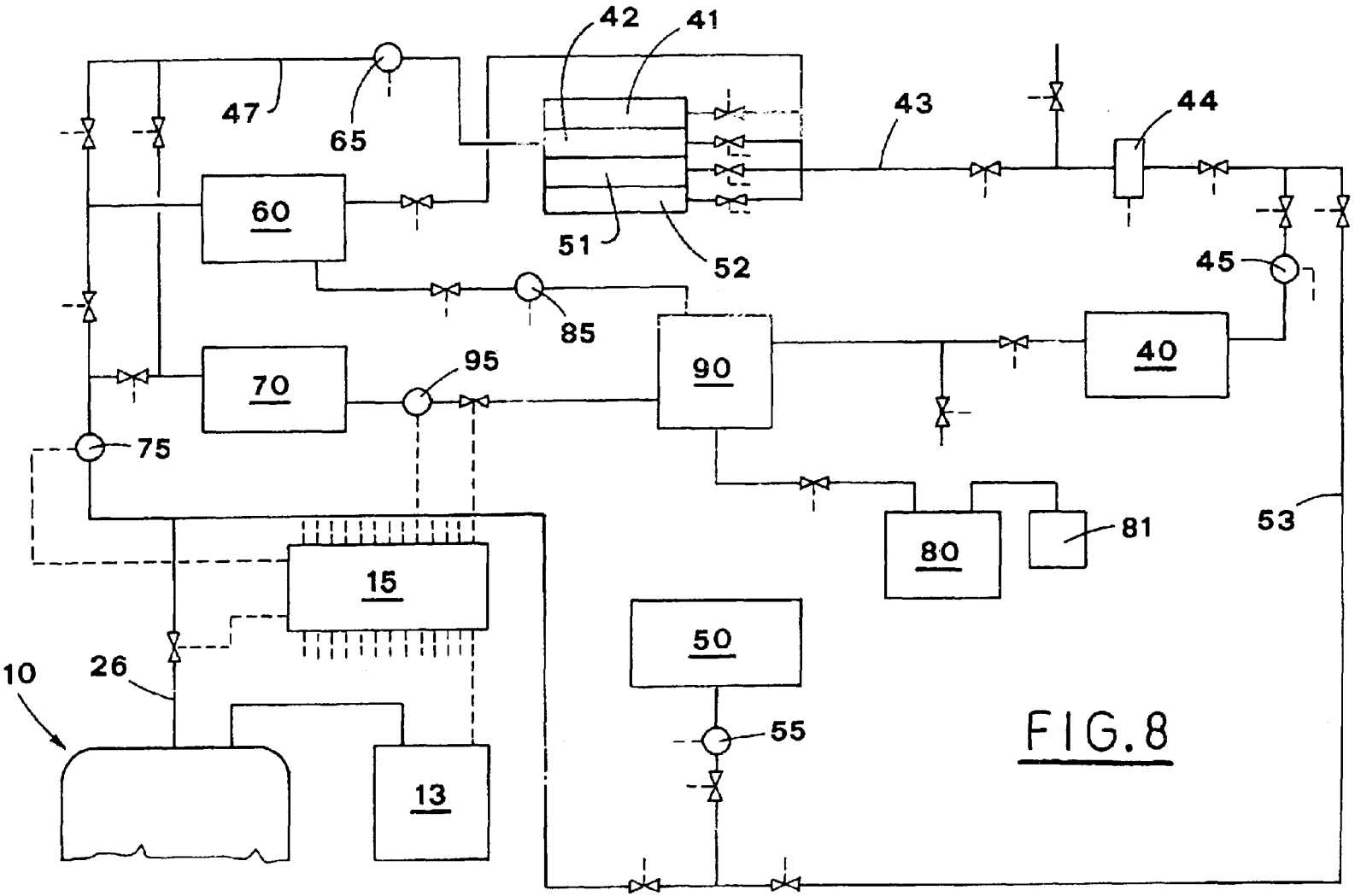
FIG. 8 is an analogous schematic view of the whole apparatus, according to a different embodiment of the proposed invention.

FIG. 8 shows a different embodiment of the equipment designed for biological tanning treatment, without using chemical products.

In particular, the biological tanning uses a tanning agent deriving from the combination of biological tannin (obtained from the plants containing tannin, such as leaves of fig, eucalyptus, and the like) and animal hair.

The apparatus uses an additional container 52 for the tanning agent, connected to the mixing reservoir 40 by a pipe 43.

In this case, the procedure includes first a hides cleaning step, as previously described.

Then, the aqueous solution composed of water, caustic soda and hydrogen dioxide is prepared in the mixing reservoir 40.

The solution prepared in the mixing reservoir 40 is sucked into the basin 12 containing the hides to be treated and previously set in vacuum condition, and the vibrating system 14 is started to facilitate the solution action.

When the hides cleaning step is finished, the depilating liquid is withdrawn from the basin 12 and introduced into the collecting reservoir 70.

Then, the mixing reservoir 50 is fed with water and then with a suitable quantity of hydrochloric acid taken from the container 51.

It is to be noted that the quantity of hydrochloric acid is equal to the quantity of caustic soda used for hides cleaning.

The so obtained acid solution is introduced into the basin 12 containing the hides for pickling.

The hydrochloric acid combines with the sodium hydroxide, thus generating sodium chloride which causes the pH lowering.

When the pickling is completed, the pickling water is removed from the basin 12 and introduced into the decantation reservoir 60. At the same time, a suitable quantity of the tanning agent is taken from the relative container 52 and introduced into the collecting reservoir 70, already containing the depilation liquid.

The so obtained solution of the depilation liquid and the tanning agent is introduced into the basin 12 to perform a further treatment step, called with more precision re-tanning.

When the re-tanning has been completed, the liquid removed from the basin 12 is introduced again to the collecting reservoir 70.

A suitable quantity of hydrochloric acid taken from the container 51 is added thereto, so as to bring the pH to about 7.

Therefore, the liquid, no more acid, can be introduced into the evaporator 90 and boiled.

As in the previous case, the depurated water can be discharged or reused, while the solid remains can be collected and used as fertilizers in agriculture.

It is understood that what above, has been described as a pure, not limitative example, therefore, possible variants of the invention remain within the protective scope of the present technical solution, as described above and claimed hereinafter.

What is claimed is:

1. A process for treating animal hides, characterized in that it includes:

spreading hides (1) to be treated astride respective support plates (2);

introducing said supporting plates (2) with said hides (1) to be treated into a container (10), which is them closed hermetically;

setting said container (10) under vacuum;

introducing a liquid treating solution into said container (10) kept under vacuum;

driving said container (10) into vibration, so as to make said treating solution introduced therein move in a constant and uniform way.

2. A process for treating animal hides, characterized in that it includes:

spreading hides (1) to be treated astride respective support plates (2);

introducing said supporting plates (2) with said hides (1) to be treated into a container (10), which is then closed hermetically;

setting said container (10) under vacuum;

introducing a liquid treating solution into said container (10) kept under vacuum.

3. A process, according to claim 1 or 2, further including an initial step, during which said hides (1) are cleaned, said initial step being performed by introducing an aqueous solution, containing dissolved hydrogen dioxide and sodium hydroxide, into said container (10).

4. A process, according to claim 3, wherein said aqueous solution contains 96% of water, and dissolved therein hydrogen dioxide in amount 2% by weight of water and sodium hydroxide, likewise in amount 2% by weight of water.

5. A process, according to claim 3, wherein said aqueous solution is heated to about 30° C.

6. A process, according to claim 3, wherein a negative pressure of about −0,5 atm is established inside said container (10) during said hides (1) cleaning step.

7. A process, according to claim 1 or 2, wherein after being cleaned by an aqueous solution of sodium hydroxide, said hides (1) are stabilized by introducing hydrochloric acid into said container (10).

8. A process, according to claim 7, wherein said hides (1) stabilizing step includes:

removing from the container (10) the cleaning liquid together with the organic remains, and introducing said cleaning liquid into a mixing reservoir (50);

introducing into said mixing reservoir (50) such a suitable quantity of hydrochloric acid that neutralizes said sodium hydroxide, generating sodium chloride;

sucking the mixture containing hydrochloric acid inside said container (10), so as to complete the hides stabilization.

9. A process, according to claim 1 or 2, further including a treatment of remains, which comprises:

transfer of aqueous suspension being the treatment remains, taken from said container (10) when the treatment is finished, to a decantation reservoir (60), so as to decant solid remains of the treatment;

treatment of said aqueous, suspension inside said reservoir (60) by adding sodium hydroxide, until pH reaches the value about 7;

transfer of only the neutralized surface aqueous solution to an evaporator (90);

bringing said aqueous solution introduced into said evaporator (90) to the boiling temperature;

distillation of the vapor produced by said aqueous solution for further recovery.

10. A process, according to claim 1 or 2, further including a treatment of remains, which comprises:

transferring the aqueous suspension being the treatment remains, taken from said container (10) when the treatment is finished, to a collecting reservoir (70);

treating said aqueous suspension inside said reservoir (70) by adding sodium hydroxide, until pH reaches the value about 7;

transferring said aqueous solution to an evaporator (90);

bringing said aqueous solution introduced into said evaporator (90) to the boiling temperature;

distillation of the vapor produced by said aqueous solution for further recovery;

suction of partially dried solid remains into a collecting reservoir (80).

11. A process, according to claim 1 or 2, further including a biologic re-tanning step, in which an aqueous suspension prepared by adding a tanning agent deriving from the combination of biological tannin and animal hair, is sucked into said container (10).

12. A process, according to claim 11, wherein said tanning agent, taken from a related container (52), is introduced into a collecting reservoir (70), containing the depilation liquid taken from said container (10) when a previous hides (1) cleaning step has finished, so as to obtain a solution of depilation liquid and tanning agent aimed at being reintroduced into said container (10), for the re-tanning step.

13. A process, according to claim 1 or 2, further including a treatment of remains, which comprises:

transferring aqueous suspension being the re-tanning step remains, taken from said container (10) when the re-tanning step is finished, to a collecting reservoir (70);

treating said aqueous suspension inside said reservoir (70) by adding sodium hydroxide, until pH reaches the value about 7;

transferring said aqueous solution to an evaporator (90);

bringing said aqueous solution introduced into said evaporator (90) to the boiling temperature;

distillation of the vapor produced by said aqueous solution for further recovery.

14. An apparatus for processing hides and the like, characterized in that it includes:

a series of plates (2) supporting hides (1) to be treated, spread astride said plates (2);

a container (10), which is closed hermetically, said supporting plates (2) with hides (1) to be treated being introduced into said container (10);

means (13) for setting said hermetically closed container (10) under vacuum;

at least one mixing reservoir (50), fed with water and suitable active principles, so as to obtain a liquid solution for treating said hides (1), said mixing container being set in communication with said hermetically closed container (10) kept under vacuum, so as to introduce thereinto said liquid solution;

a vibrating element (14) for driving said container (10) into vibration, so as to make said liquid solution introduced into said hermetically closed container (10) move in a constant and uniform way.

15. An apparatus, according to claim 14, wherein said hermetically closed container (10) comprises a cylindrical pot (11) with a watertight cover, and a quadrangular basin (12) situated inside said pot, said basin (12) being aimed at receiving said plates (2) supporting hides (1).

16. An apparatus, according to claim 14, wherein said plates (2) are introduced into seats defined inside said basin (12) by guiding means (20) fastened to the opposite walls of said basin (12), with upper ends of said guiding means being suitably tapered to facilitate the plates (2) introduction.

17. An apparatus, according to claim 16, further including a transferring device (3) for inserting said plates (2) into seats defined by said guiding means (20), said transferring device being equipped with at least one pair of pliers means (30) driven by an actuator (34) carried by slide means (35,37) and movable vertically in orthogonal directions, so as to move said pliers means (30) between a position **(30*a*), in which said plates (2) are removed from a carriage (6) and a position (30*b*), in which the plates (2) are released inside the basin (12)**.

18. An apparatus, according to claim 17, wherein said pliers means (30) include respectively a fork (31) with a tapered introduction section for inserting said plate (2), said fork having a coupling element (32) operated pneumatically for coupling with a corresponding hole (22) made in said plate (2).

19. An apparatus, according to claim 14, further including a plurality of reservoirs (60, 70) for respectively decanting and collecting liquids, remaining when the working cycle is finished and fed by a pipe (26) deriving from said container (10), said decanting reservoir (60) and collecting reservoir (70) being connected to an evaporator (90), said evaporator being aimed at boiling the liquids remaining when the working cycle is finished, said decanting reservoir (60) and collecting reservoir (70) being also connected to a container (42) of sodium hydroxide.

* * * * *